United States Patent [19]

Tojo et al.

[11] 4,350,479

[45] Sep. 21, 1982

[54] SCROOL-TYPE FLUID MACHINE WITH LIQUID-FILLED FORCE-BALANCED POCKETS

[75] Inventors: Kenji Tojo; Masato Ikegawa; Masao Shiibayashi; Masaya Imai, all of Ibaraki, Japan

[73] Assignee: Hitachi, Ltd., Tokyo, Japan

[21] Appl. No.: 138,730

[22] Filed: Apr. 9, 1980

[30] Foreign Application Priority Data

Apr. 11, 1979 [JP] Japan ..... 54/43077

[51] Int. Cl.[3] ..... F01C 1/02; F01C 21/00

[52] U.S. Cl. ..... 418/55; 418/57; 418/71; 418/72; 418/76; 418/77; 418/99

[58] Field of Search ..... 418/55, 57, 71, 72, 418/76, 77, 99

[56] References Cited

U.S. PATENT DOCUMENTS 3,874,827 4/1975 Young ..... 418/55

3,884,599 5/1975 Young et al. ..... 418/55

FOREIGN PATENT DOCUMENTS 3019642 12/1980 Fed. Rep. of Germany ..... 418/55

*Primary Examiner*—John J. Vrablik

*Attorney, Agent, or Firm*—Antonelli, Terry & Wands

[57] ABSTRACT

A scroll-type fluid machine is provided with a plurality of liquid-confining pockets formed in the sliding surface of the end member of either one of orbiting and stationary scrolls. In operation, a high liquid pressure is generated in the pocket or pockets positioned in the region where a localized high axial urging force is exerted during operation, so that the localized high axial urging force acting on the two scrolls is partially or fully negated.

42 Claims, 11 Drawing Figures

SCROOL-TYPE FLUID MACHINE WITH LIQUID-FILLED FORCE-BALANCED POCKETS

BACKGROUND OF THE INVENTION

The present invention relates to a scroll-type fluid machine which is generally used as a gas compressor for compressing air, ordinary gases, refrigerant gas or the like, as an expander for expanding gases and as a pump for handling liquids.

DESCRIPTION OF THE PRIOR ART

Scroll-type fluid machines, such as a scroll-type compressor, expander and pump, are well known to those skilled in the art. The scroll-type fluid machine has a pair of scroll means each having a spiral wrap formed along an involute curve on an end member and extending upright therefrom. These scroll means are disposed to oppose to each other with a rotation-preventing member referred to as Oldham ring, disposed between the two scroll means to assure that one of two scroll means is prevented from rotating about its own axis when it makes an orbital movement relative to the other scroll member which is kept stationary. A high-pressure port is formed in the central portion of the end plate and constitutes, in case of a compressor or pump, a discharge port from which a pressurized fluid is discharged. In the case of an expander, the high-pressure port constitutes a fluid inlet port through which a high-pressure fluid is introduced into the expander. A low-pressure port is disposed at radially outer side of the wraps.

During the operation, fluid pressure is exerted to the back side, i.e., the opposite side of the wrap, of one of the scroll means in order to prevent the two scroll means from being separated apart from each other in the axial direction. The force of fluid confined between the two scroll means acts on an axial or heightwise mid-point of the wraps, whereas, another force acts on one of the scroll means at a point positioned on the side thereof opposite to the wrap. In the case of a pump or compressor, the other force is operative to orbit the one scroll means, whereas, in the case of an expander, the other force is the load on the one scroll means. Since the points of the application of these two forces are spaced from each other, and since these forces act as action force and a reaction force, these forces in combination produce a moment which acts on the one scroll means so that a localized part of the one scroll means is urged against the other scroll means. Thus the rate of the wear of the contacting or sliding surfaces of both scroll means is increased and the loss of power due to friction is increased. In addition, the uneven contact between the two scroll means degrades the seal between the suction and discharge sides as well as the seal between adjacent working chambers in the compression stroke.

The pressure of the fluid confined between the two scroll means also produces a force which acts to separate the scroll means apart from each other in the axial direction. U.S. Pat. No. 4,065,279 issued prior to the filling date of the present application discloses a scroll-type apparatus provided with a hydrodynamic thrust bearing for bearing the above-mentioned separating force. This prior art, however, neither discloses the localized concentration of urging force produced between two scroll means nor suggests any measure to eliminate the local or uneven contact pressure between the two scroll means.

SUMMARY OF THE INVENTION

It is, therefore, an object of the present invention to avoid the localized concentration of axial urging force produced between the orbiting scroll means and the statioinary scroll means to thereby ensure a uniform axial pressure distribution all over the entire contacting surfaces of these scroll means.

It is another object of the present invention to diminish the loss of power caused due to friction between the two scroll means.

It is a further object of the present invention to stabilize the orbital movement of the orbiting scroll means to thereby diminish the leakage of fluid which would otherwise be caused by unstable orbital movement of the orbiting scroll means.

It is a further object of the present invention to provide a scroll-type fluid machine having a large ratio of output to input level, i.e, a high working efficiency.

It is a still further object of the present invention to provide a scroll-type fluid machine in which the wear of the sliding surfaces of the two scroll means is minimized.

In order to achieve the objects discussed above, the present invention provides a scroll-type fluid machine characterized in that pockets are formed in the sliding surface of the end member of one of the orbiting and stationary scroll means to confine a liquid such as lubricating oil, and a high hydraulic pressure is generated in the pocket positioned in the region to which a large localized urging force is exerted, to thereby negate the localized axial urging force acting on the scroll means.

The pockets are separated from each other in the circumferential direction of the scroll means.

The above and other objects, features and advantages of the present invention will be made apparent by the following description with reference to the accompanying drawings.

DESCRIPTION OF PREFERRED EMBODIMENTS

Figure 1:
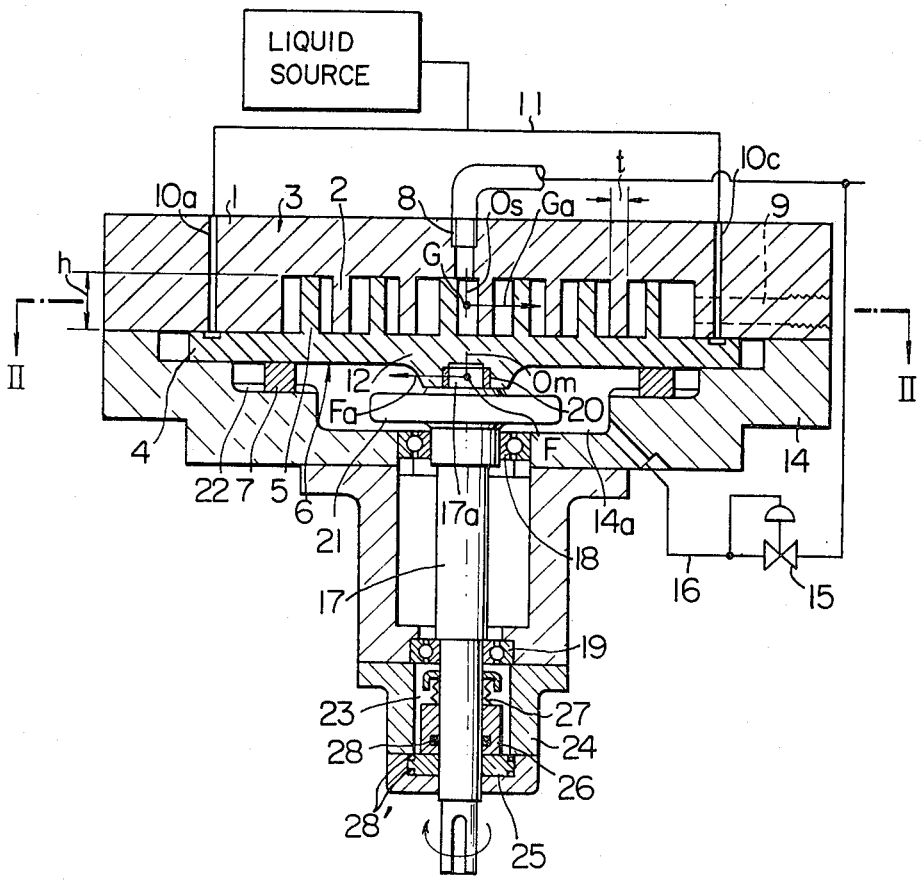
FIG. 1 is a vertical sectional view of a scroll-type fluid machine constructed according to a first embodiment of the invention.

Scroll-type fluid machines have substantially identical basic arrangement irrespective of whether they are used as compressor, expander or pump. In this specification, therefore, the description will be focused, by way of example, on a compressor.

FIGS. 1 to 4 in combination show a first embodiment of the invention in which pocket is formed in a stationary scroll member.

The stationary scroll means generally designated by the reference numeral 3 includes a disc-shaped end member 1 and a wrap 2 formed along an involute curve or a curve approximating the involute curve and projecting upright from one surface of the end member 1. The wrap 2 has a uniform thickness t and a height h over its entire length. A dischrge port 8 is formed at the center of the scroll means 3 and a suction port 9 is provided in the peripheral wall of the scroll means 3. The stationary scroll means 3 further has a plurality of oil feed ports which are disposed at equal angular intervals and at equal radial distance from the center Os of the scroll means. In the illustrated embodiment, four oil feed ports 10*a*, 10*b*, 10*c* and 10*d* are provided. These oil feed ports 10*a*–10*d* are connected to a lubricating oil pump (not shown) through a common oil pipe 11. It is possible to use the discharge pressure of the machine fluid in place of such pump.

On the other hand, an orbiting scroll member generally designated by the reference numeral 6 includes a disc-shaped end member 4 and a wrap 5 extending from one surface of the end member, with the wrap 5 having the same contour as the wrap 2 of the stationary scroll means 3. The orbiting scroll member 6 further includes a scroll boss 12 formed on the surface thereof opposite to the surface having the wrap 5 thereon. The side or surface having the scroll boss 12 will hereinafter be referred to as "back side" or "back surface".

The axis of the scroll boss 12 extends through the center $O_m$ of the orbiting scroll means 6. The end member 4 of the orbiting scroll means 6 is provided, in a surface in sliding contact with the end member 1 of the stationary scroll means 3, with a plurality of fluid pockets arranged at equal radial distances from the center $O_m$. The number of the pockets correspond to the number of the oil feed ports 10. Thus, in the illustrated embodiment, there are formed four pockets 13*a*, 13*b*, 13*c* and 13*d*. These pockets 13*a*–13*d* are formed independently of one another. The number of the fluid pockets 13 and oil feed ports 10 is not limited to four but is preferably not less than three.

Figure 2:
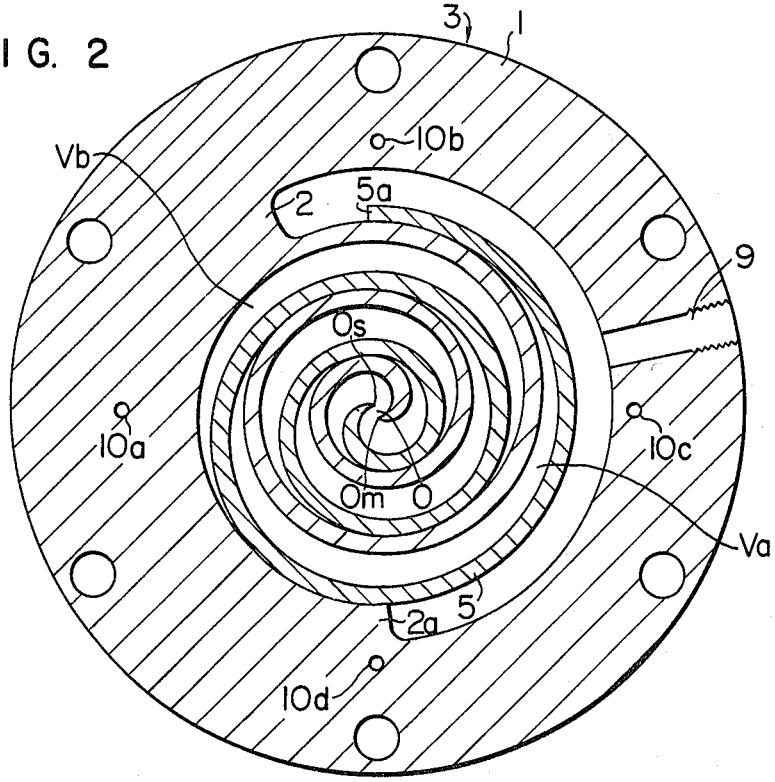
FIG. 2 is a sectional view taken along the line II—II in FIG. 1.

The stationary scroll means 3 and the orbiting scroll means 6 are arranged in face-to-face relationship with their wraps 2 and 5 extending toward each other and arranged such that the outer end 2*a* of the wrap 2 and the outer end 5*a* of the wrap 5 are positioned in symmetry with each other with respect to the mid point O of a line interconnecting the two centers $O_m$ and $O_s$, as will be clearly understood fro FIG. 2.

FIGS. 4*a* to 4*d* show the positional relationship between the oil feed ports 10*a*–10*d* and the pockets 13*a*–13*d* in the two scroll members 3, 6 at each 90° rotation. More specifically, the oil feed ports 10*a*–10*d* and the pockets 13*a*–13*d* successively take positions shown in FIGS. 4*a*, 4*b*, 4*c* and then 4*d*.

The oil feed ports 10*a*–10*d* are arranged at 90° intervals on a circle having a radius R from the center $O_s$ of the stationary scroll means 3, whereas the pockets 13*a*–13*d* are arranged also at 90° intervals on a circle of the same radius R as that for the oil feed ports 10*a*–10*d* but measured from the center $O_m$ of the orbiting scroll means 6.

The relative positions between the oil feed ports 10*a*–10*d* and the pockets 13*a*–*13d* are successively changed as the center $O_m$ of the orbiting scroll means 6 revolves or orbits around the center $O_s$ of the stationary scroll means 3. Namely, in the position shown in FIG. 4*a*, the oil feed port 10*d* is communicated with the pocket 13*d*. Similarly, in the positions shown in FIGS. 4*b*, 4*c* and 4*d*, the oil feed ports 10*a*, 10*b* and 10*c* are communicated with the pockets 13*a*, 13*b* and 13*c*, respectively.

A frame 14 is fixed to the surface of the stationary scroll means 3 having the wrap 2, by means of a plurality of bolts (not shown). A recess 14*a* is formed in the surface of the frame 14 directed to the statinary scroll means 3. The space defined in this recess 14*a* is connected to the discharge port 8 through a conduit or line 16 provided with a pressure reducing valve 15 therein.

A crank shaft 17 is rotatably supported by bearings 18 and 19 attached to the frame 14. The axis of the crank shaft coincides with the center $O_s$ of the stationary scroll means 3. The crank shaft 17 is provided at its one end with a crank pin 17*a*, the center of which is spaced from the axis of the crank shaft 17 by a distance equal to the distance between the centers $O_s$ and $O_m$ (this distance is generally referred to as "orbit radius"). This crank pin 17*a* is received in a recess formed in the scroll boss 12 with a bearing 20 disposed therebetween. A balancing weight 21 is attached to the crank shaft 17.

Figure 3:
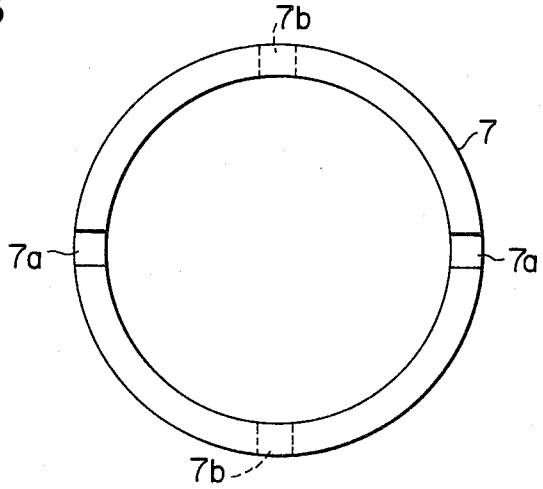
FIG. 3 is a front view of an Oldham ring.
Figure 4A:
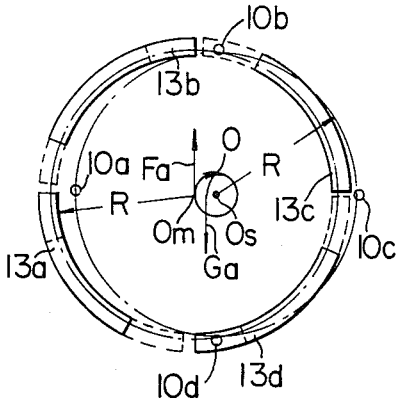
FIGS. 4*a*–4*d* illustrate relative positions of oil feed ports and pockets.
Figure 4B:
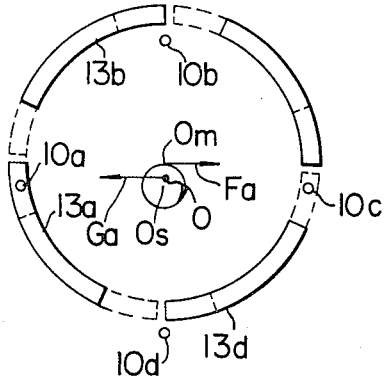
Figure 4C:
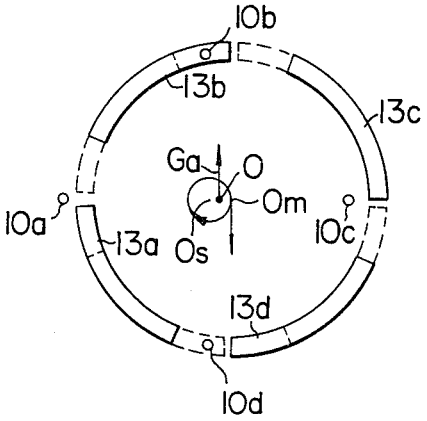
Figure 4D:
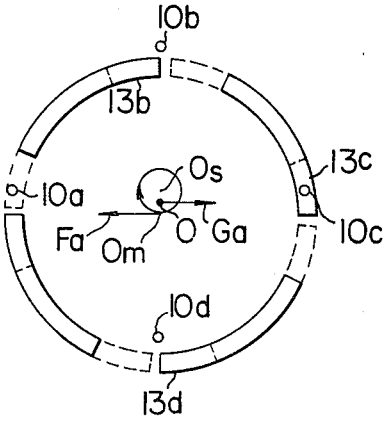

An Oldham ring 7, which is a member for preventing the orbiting scroll means 6 from rotating around its own axis, has grooves 7*a* formed in its one surface and orthogonal grooves 7*b* formed in its other surface, as will be seen in FIG. 3. The Oldham ring 7 is disposed between the frame 14 and the back side of the orbiting scroll means 6. Oldham keys 22 fixed to the frame 14 are received in the grooves 7*a* of the Oldham ring 7. Similarly, Oldham keys (not shown) are fixed to the orbiting scroll means 6 and received in the grooves 7*b*.

A mechanical seal 23 is accommodated in a housing 24 which is fixed to the frame 14. The mechanical seal 23 includes a seal ring 25 fixed to the housing 24, a floating ring 26 movably mounted on the crank shaft, springs 27 for pressing the floating ring 26 against the seal ring 25 and "O" rings 28 and 28' for providing seals between the crank shaft 17 and the floating ring 26 and between the housing 24 and the seal ring 25.

During the operation of the scroll-type compressor of this embodiment, the urging force locally applied to the orbiting scroll means 6, hereinafter termed as "localized urging force", is negated as will be understood from the following description.

The lubricating oil is forcibly supplied to the oil feed ports 10*a*–10*d* through the common oil feed pipe 11. Since the relative position between the stationary scroll means 3 and the orbiting scroll means 6 is changed due to the orbital movement of the scroll means 6, communications are established successively between the oil feed port 10*d* and the pocket 13*d*, between the oil feed port 10*a* and the pocket 13*a*, between oil feed port 10*b* and the pocket 13*b* and between the oil feed port 10*c* and the pocket 13*c*, so that the lubricating oil is intermittently supplied into the respective pockets 13*a*, 13*b*, 13*c* and 13*d*.

On the other hand, as shown in FIGS. 1 and 4*a*–4*d*, the driving force Fa causing the orbital movement of the orbital scroll means 6, i.e., the force causing the compression, acts on the axis through center $O_m$ of the orbiting scroll means 6, whereas the force agaisnt the compression, i.e., the force generated by the pressure of the gas in the closed working chambers Va, Vb . . . , acts on the axis through the mid point O of the line interconnecting the centers $O_s$ and $O_m$ of the two scroll means 3 and 6. As to the axial force, the force Fa acts on the axial midpoint F of the axial length of the crank pin 17*a* and, hence, the scroll boss 12, whereas the force Ga acts on the heightwise midpoint G of the wrap 5 of the orbiting scroll means 6.

Therefore, the localized urging force is applied substantially only to that side of the line connecting the centers $O_m$ and $O_s$ of orbiting and stationary scroll means in which the force Fa for causing the orbital movement of the orbiting scroll means 6 i directed. The region to which this localized urging force is exerted is the upper side of the center $O_s$ in the state shown in FIG. 4*a*. Similarly, this localized urging force is applied to the right side, lower side and left side of the center $O_s$, respectively, in the positions shown in FIGS. 4*b*, 4*c* and 4*d*. Thus, the region to which the localized urging force is applied is circumferentially moved or shifted following the orbital movement of the orbiting scroll means 6.

As will be understood from FIGS. 4*a* to 4*d*, any pocket 13 located in the region which is subjected to the localized urging force is not in communication with any oil feed portion 10*a*–10*d* in any of the conditions shown in FIGS. 4*a* to 4*d*. As a strong urging force is applied to the region in which the pocket is closed and not communicated with any oil feed port 10*a*–10*d*, the oil in the pocket is pressurized to generate a pressure which acts against the localized urging force to negate a part or whole of the same.

In this first embodiment, the oil pressure for negating the localized urging force is produced by the action of this localized urging force itself. This oil pressure, however, may be obtained from the pressure of the lubricating oil forcibly supplied by the lubricating oil source (not shown). In this case, it is necessary to suitably adjust the lubricating oil pressure and the area of the pocket 13 such that the localized urging force is negated by the oil pressure established in the pocket and also to permit the pocket 13 in the region under the localized urging force to communicate with the oil feed port 10. The adjustment of the oil pressure can easily be made by providing a pressure regulating valve at an intermediate portion of the oil feed pipe 11, whereas the communication of the pocket with the oil feed port can be achieved, for example, by modifying the positions of the pockets 13*a*–13*d* as shown by broken lines in FIGS. 4*a* to 4*d*.

The described embodiment affords an easy design and simple construction of the oil feed passage, as well as an easy piping work at the outside of the compressor, because the oil feed passage is formed in the stationary scroll means 3. For the same reason, this embodiment can suitably be applied to open-type machines.

Figure 6:
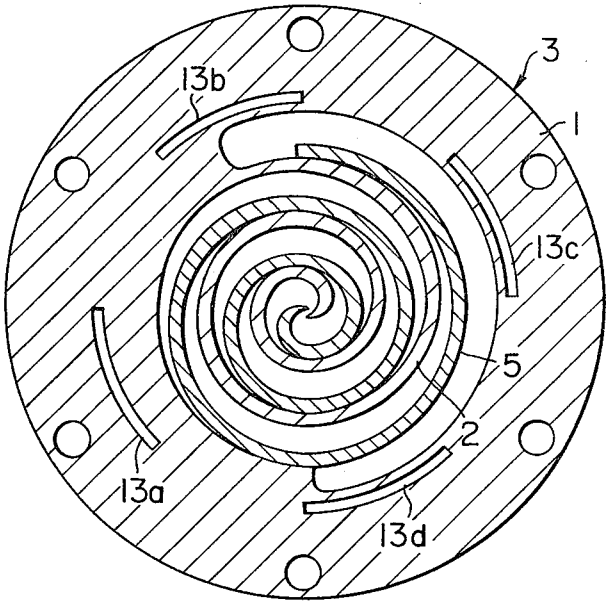
FIG. 6 is a sectional view taken along the line VI—VI in FIG. 5.
Figure 5:
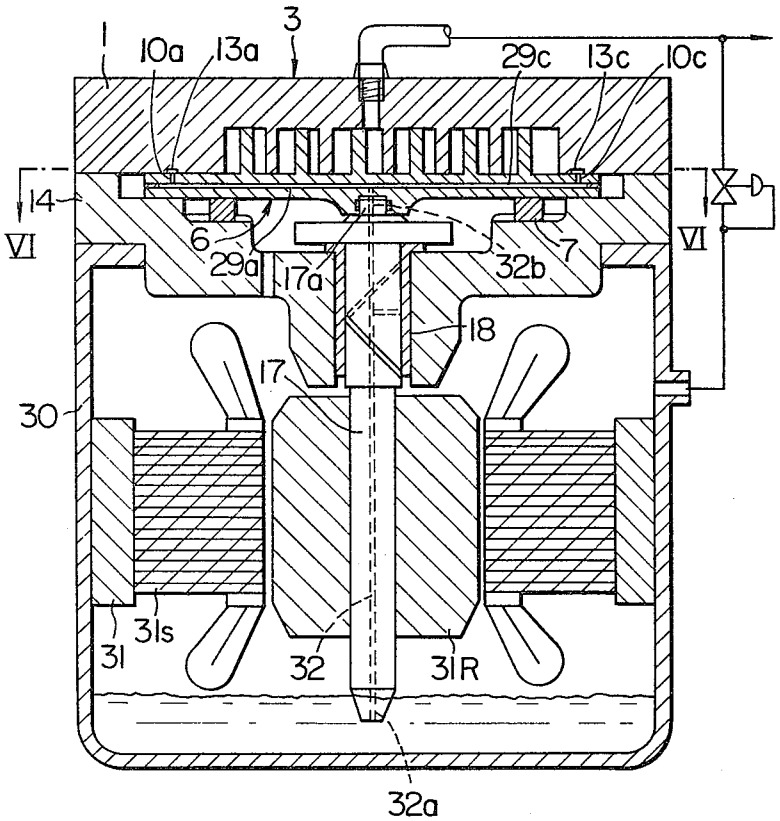
FIG. 5 is a vertical sectional view of a second embodiment of the invention.

FIGS. 5 and 6 show a second embodiment of the invention, in which parts or members similar to those shown in FIGS. 1 to 4 are denoted by the same reference numerals and, therefore, description of these parts or members is omitted.

In this second embodiment, the oil feed parts 10*a*–10*d* are provided in the orbiting scroll member 6, whereas, the pockets 13*a*–13*d* are formed in the end member 1 of the stationary scroll means 3. The positional relationship between the oil feed ports 10*a*–10*d* and the pockets 13*a*–13*d* is identical to that in the first embodiment.

The oil feed ports 10*a*–10*d* are communicated with the central bore in the scroll boss 12 through respective passages (only two passages 29*a* and 29*c* are shown in FIG. 5). A chamber 30, accommodating a motor 31 therein, is fixed to the frame 14 in an airtight manner. The motor 31 includes a stator 31S mounted on the inner surface of the chamber 30 and a rotor 31R fixed to the crank shaft 17.

As eccentric bore 32 is formed in the crank shaft 17 and extends substantially in the axial direction between the lower end of the crank shaft 17 and the crank pin 17*a*. This eccentric bore 32 is inclined to the axis of the crank shaft 17 such that its lower end 32*a* opens on the axis of the crank shaft 17 at the lower end thereof, whereas, the upper end 32*b* of the bore 32 opens in the surface of the crank pin 17*a* at a position offset from the axis of the crank shaft 17. It may appear in FIG. 5 that the eccentric bore 32 extends along the axis of the crank shaft 17. The eccentricity and inclination of this bore 32, however, will become apparent if the crank shaft 17 is rotated by 90° from the position shown in FIG. 5.

In operation, the lubricating oil accumulated in the bottom well or oil pan of the chamber 30 is sucked by the pumping action of the eccentric bore 32 which is generated as the crank shaft 17 rotates, and is supplied to the pockets 13*a*–13*d* successively and intermittently through the passages 29*a*–29*d* and the oil feed ports 10*a*–10*d*.

Operations of the other portions are identical to those of the first embodiment and thus are not described here. This second embodiment can suitably be applied to a closed type machine having a lubricating oil pump constituted by an eccentric bore formed in a crank shaft.

Figure 8:
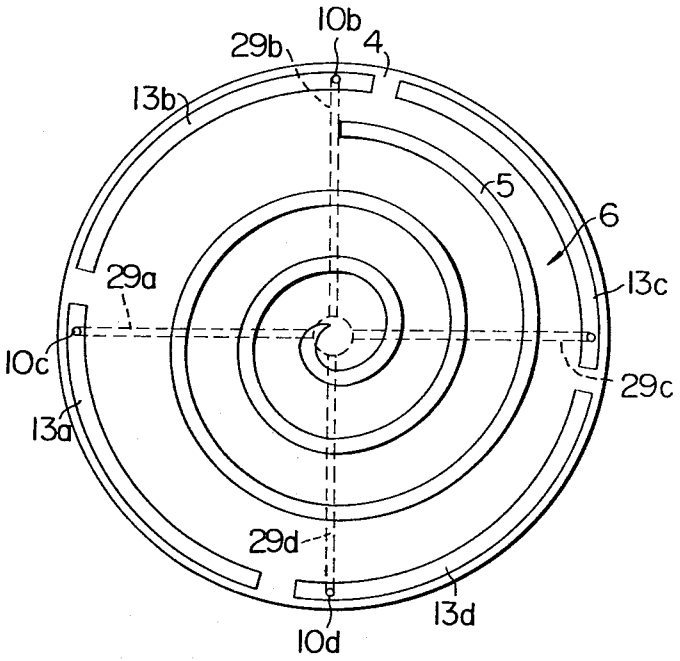
FIG. 8 is a front view of an orbiting scroll member as viewed from the same side as the scroll wrap.
Figure 7:
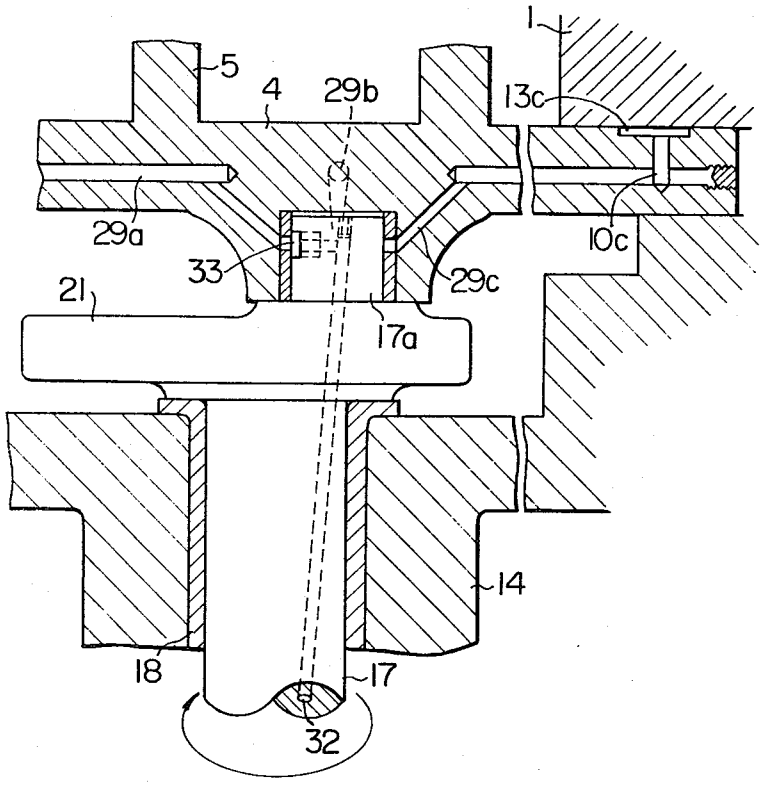
FIG. 7 is an enlarged fragmentary sectional view of the essential part of a third embodiment of the invention.

FIGS. 7 and 8 show a third embodiment of the invention, in which the parts or members similar to those in FIGS. 5 and 6 are designated by similar reference numerals. The description of these parts and members is omitted.

Four pockets 13*a*–13*d* are formed in the sliding surface of the end member 4 of the orbiting scroll means 6. Also, the oil feed ports 10*a*–10*d* and oil feed passages 29*a*–29*d* are formed in the orbiting scroll means 6. The oil feed passages 29*a*–29*d* open at 90° intervals in the peripheral wall of the bore in the scroll boss 12 for receiving the crank pin 17*a*. An oil passage port 33 opens in the peripheral surface of the crank pin 17*a* over a predetermined circumferential length, i.e., over a predetermined angular range, and is communicated with the eccentric bore 32. The position of the oil passage port 33 is preferably so selected as to permit the supply of lubricant oil to the pocket or pockets 13 which are positioned in the region which is free from the localized urging force of the orbiting scroll means 6. However, the position of the oil passage port 33 may alternatively be so selected as to permit the lubricating oil supply to the pocket or pockets 13 positioned in the region which is subjected to the localized urging force of the orbiting scroll means 6.

In operation, the oil sucked up from the bottom well of the chamber 30 by the pumping action of the eccentric bore 32 is supplied to the oil passage port 33. Since the orbiting scroll means 6 does not rotate about its own axis, the oil passage port 33 is brought into communication sequentially with the oil feed passages 29*a*, 29*b*, 29*c* and then 29*d*. Consequently, the lubricating oil is supplied sequentially and intermittently to the pockets 13*b*, 13*c*, and 13*d* and 13*a* through respective passages 29*a*, 29*b*, 29*c* and 29*d*. Since the pocket or pockets 13 in the region which is subjected to the localized urging force of the orbiting scroll means 6 are in closed state, a hydraulic pressure corresponding to the localized urging force is generated in that pocket or pockets to at least partially negate the localized urging force.

In this third embodiment of the invention, it is possible to form the pockets 13 in the sliding surface of the end member 1 of the stationary scroll means 3. In such a case, however, it is necessary to suitably select the positions and areas of the oil feed ports 10 and the pockets 13 so that the communication between the pockets 13 and the oil feed ports 10 is continuously maintained irrespective of changes of the relative positions of the stationary and orbiting scroll means 3 and 6.

This embodiment makes use of the relative movement between the crank pin and the orbiting scroll means 6 in effecting the intermittent lubricating oil supply to the pockets 13. It is, therefore, not necessary to pay attention to obtaining such a positional relationship between the oil feed ports 10 and the pockets 13 that they are intermittently brought into and out of communication with each other in accordance with the orbital movement of the orbiting scroll means 6. This provides a greater degree of freedom in selection and designing of the size and position of the pockets 13.

Although four oil feed ports 10 and four pockets 13 are used in the described embodiments, the number of oil feed ports and pockets is not at all exclusive. The minimum number of the oil feed ports 10 and pockets 13 required for partially or wholly negating the localized axial urging force is three. A greater number of the pockets 13 ensures a higher stability in partially or completely negating the localized urging force, i.e., a minimized variation in the magnitude of the negating force. However, the increase in the number of the pockets 13, on the other hand, complicates the work to form the pockets 13 and the oil feed ports 10. It is, therefore, necessary to take both factors into consideration to decide the number of the pockets 13.

There is a land between each adjacent pair of pockets 13. The width of each land is so determined that the land functions not only to separate an adjacent pair of pockets 13 but also to prevent an oil feed port 10 from being simultaneously communicated with two pockets 13. This arrangement is common to the first and second embodiments.

Any of the foregoing embodiments of the invention assures a partial or complete negation of the localized urging force as well as a good lubrication between the stationary and orbiting scroll means to facilitate an effective and smooth operation of the machine.

As described above, according to the invention, pockets are formed in the sliding surface of the stationary or orbiting scroll means 3, 6, so that a hydraulic pressure is generated in that pocket 10 which is positioned in the region subjected to a localized urging force to partially or completely negate the localized urging force applied to the orbiting scroll means 6. Thus, the invention provides advantages that the loss of power caused due to the friction between the sliding surfaces of the stationary and orbiting scroll means 3, 6 is reduced and that an improved uniform contact is maintained between the end member of the stationary and orbiting scroll means 3, 6 as well as between both wraps 2, 5 to reliably prevent leakage of the liquid.

What is claimed is:

1. A scroll-type machine comprising:

a stationary scroll means including an end member and a spiral wrap extending from one surface of said end member;

an orbiting scroll means including an end member and a spiral wrap extending from a surface of said end member thereof;

a rotation-preventing member adapted to prevent said orbiting scroll means from rotating about its own axis;

a frame secured to said stationary scroll means;

a crank shaft supported by said frame for rotation about an axis coincident with the axis of said stationary scroll means and having an engagement member located at a position spaced from the axis of the rotation of said crank shaft by a distance equal to a radius of an orbital movement of said orbiting scroll means, said engagement member being adapted to transmit power between said orbiting scroll means and said crank shaft;

a low pressure port;

a high pressure port;

a plurality of circumferentially spaced pockets formed in the end member of one of said stationary and orbiting scroll means and being adapted to confine a liquid therein;

liquid supplying passage means for supplying said liquid to each of said pockets;

intermittent liquid supplying means for controlling a supply of said liquid to each pocket through said liquid supplying passage means such that the supply of said liquid to each pocket is made intermittently at a constant cycle; and a source of liquid to be supplied to said pockets.

2. A scroll type fluid machine as claimed in claim 1, wherein said pockets are formed in a sliding surface of said end member of said orbiting scroll means facing said stationary scroll means, said liquid supplying passage means are provided in said stationary scroll means, and wherein the control of supply of said liquid made by said intermittent liquid supplying means is achieved by a change of relative positions between said pockets and said liquid supplying passage means and by a relative movement between said orbiting scroll means and said stationary scroll means.

3. A scroll-type fluid machine as claimed in claim 1, wherein said pockets are formed in a sliding surface of said member of said stationary scroll means facing said orbiting scroll means, said liquid supplying passage means are provided in said orbiting scroll means and said crank shaft, and wherein the control of supply of said liquid made by said intermittent liquid supplying means is achieved by a change of relative positions between said pockets and said liquid supplying passage means and by a relative movement between said orbiting scroll means and said stationary scroll means.

4. A scroll-type fluid machine as claimed in claim 1, wherein said pockets are formed in a sliding surface of said end member of said oribting scroll means facing said stationary scroll means, said liquid supplying passage means being provided in said orbiting scroll means and said crank shaft, and wherein the control of the intermittent supply of said liquid made by said intermittent liquid supplying means is achieved by a relative movement between said orbiting scroll means and said crank shaft.

5. A scroll-type fluid machine as claimed in one of claims 1, 2, 3 or 4, wherein said intermittent liquid supplying means are arranged such that a communication between said liquid source and the pocket, positioned in a region where a localized axial urging force of said orbiting scroll means is exerted, is interrupted and such that the other pockets are communicated with said liquid source.

6. A scroll-type fluid machine as claimed in one of claims 1, 2, 3 or 4, wherein said intermittent liquid supplying means are arranged such that the pocket, positioned in a region where a localized axial urging force of said orbiting scroll means is exerted, is communicated with said liquid source and that a communication between the other pockets and said liquid source is interrupted.

7. A scroll-type fluid machine as claimed in one of claims 1, 2, 3 or 4, wherein said pockets are arranged at substantially equal angular intervals on a circle of a predetermined radius from a center of said end member of said orbiting scroll means and said liquid supplying passage means include a plurality of ports adapted to be brought into registry with said pockets, said ports being formed in said stationary scroll means and arranged on a circle of a predetermined radius from the center of said end member of said stationary scroll means.

8. A scroll-type fluid machine as claimed in one of claims 1, 2, 3, or 4, wherein said pockets are arranged at substantially equal angular intervals on a circle of a predetermined radius from a center of said stationary scroll means and said liquid supplying passage means include ports, adapted to be brought into registry with said pockets, arranged on a circle of a predetermined radius from the center of said end member of said orbiting scroll means.

9. A scroll-type fluid machine as claimed in one of claims 1, 2, 3 or 4, wherein said pockets are arranged on a circle of a predetermined radius from a center of said end member of said orbiting scroll means and said liquid supplying passage means include ports which are open to said pockets and are arranged on the same circle as said pockets.

10. A scroll-type fluid machine as claimed in one of claims 1, 2, 3, or 4, wherein at least three pockets are provided and said liquid supplying passage means include at least three ports.

11. A scroll-type fluid machine comprising:

a stationary scroll means including an end member and a spiral wrap extending from one surface of said end member;

an orbiting scroll means including an end member, a spiral wrap extending from one surface of said end plate of the orbiting scroll means and a scroll boss provided on the other surface of said end member of the orbiting scroll means;

a rotation-preventing member adapted to prevent said orbiting scroll means from rotating about its own axis;

a frame secured to said stationary scroll means;

a discharge port formed in the central portion of said stationary scroll means;

a suction port formed in an outer peripheral portion of said stationary scroll means;

a crank shaft supported by said frame for rotation about an axis coincident with the axis of said stationary scroll means and having a crank pin disposed at a portion spaced from the axis of rotation of said crank shaft by a distance equal to a radius of an orbital movement of said orbiting scroll means, said crank pin being in engagement with said scroll boss of said orbiting scroll means;

a plurality of circumferentially spaced oil pockets formed in the end member of one of said stationary and orbiting scroll means, said pockets being adapted to confine oil therein;

a liquid supplying passage means adapted to supply oil to each of said pockets;

intermittent liquid supplying means adapted to control a supply of oil to said pockets through said liquid supplying passage means such that the oil supply is made intermittently at a constant cycle; and a source of pressurized oil from which oil is supplied to said pockets.

12. A scroll-type fluid machine as claimed in claim 11, wherein said pockets are formed in a sliding surface of said end member of said orbiting scroll means facing said stationary scroll means, said liquid supplying passage means are provided in said stationary scroll means, and wherein a control of the supply of said liquid by said intermittent liquid supplying means is achieved by a change of relative positions between said pockets and said liquid supplying passage means and by a relative movement between said orbiting scroll means and said stationary scroll means.

13. A scroll-type fluid machine as claimed in claim 11, wherein said pockets are formed in a sliding surface of said end member of said stationary scroll means facing said orbiting scroll member, said liquid supplying passage means are provided in said orbiting scroll means and said crank shaft, and wherein a control of the supply of said oil by said intermittent liquid supplying means is achieved by a change of relative positions between said pockets and said liquid supplying passage means and by a relative movement between said orbiting scroll means.

14. A scroll-type fluid machine as claimed in claim 11, wherein said pockets are formed in a sliding surface of said end member of said orbiting scroll member facing said stationary scroll means said liquid supplying passage means are provided in said orbiting scroll means and said crank shaft, and wherein a control of the intermittent supply of said oil by said intermittent liquid supplying means is achieved by a relative movement between said orbiting scroll means and said crank shaft.

15. A scroll-type fluid machine as claimed in one of claims 11, 12, 13, or 14, wherein said intermittent liquid supplying means are arranged such that a communication is interrupted between said source of pressurized oil and the pocket positioned in a region where a localized axial urging force of said orbiting scroll means is exerted and such that the other pockets are communicated with said liquid source.

16. A scroll-type fluid machine as claimed in one of claims 11, 12, 13, or 14, wherein said intermittent liquid supplying means are arranged such that the pocket, positioned in a region where a localized axial urging force of said orbiting scroll means is exerted, is communicated with said souce of pressurized oil and that a communication between the other pockets and said source of pressurized oil is interrupted.

17. A scroll-type fluid machine as claimed in one of claims 11, 12, 13 or 14, wherein said pockets are arranged at substantially equal angular intervals on a circle of a predetermined radius from a center of said end member of said orbiting scroll means and said liquid supplying passage means includes a plurality of ports adapted to be brought into registry with said pockets, said ports being formed in said stationary scroll means and arranged on a circle of a predetermined radius from the center of said end member of said stationary scroll means.

18. A scroll-type fluid machine as claimed in one of claims 11, 12, 13, or 14, wherein said pockets are arranged at substantially equal angular intervals on a circle of a predetermined radius from a center of said stationary scroll means and said liquid supplying passage means includes ports adapted to be brought into registry with said pockets and arranged on a circle of a predetermined radius from the center of said end member of said orbiting scroll means.

19. A scroll-type fluid machine as claimed in one of claims 11, 12, 13 or 14, wherein said pockets are arranged on a circle of a predetermined radius from a center of said end member of said orbiting scroll means and said liquid supplying passage means include ports which are open to said pockets, said ports are arranged on the same circle as said pockets.

20. A scroll-type fluid machine as claimed in one of claims 11, 12, 13, or 14, wherein at least three pockets are provided and wherein said liquid supplying passage means include at least three ports.

21. A scroll-type fluid machine as claimed in claim 5, wherein said pockets are arranged at substantially equal annular intervals on a circle of a predetermined radius from a center of said end member of said orbiting scroll means and said liquid supplying passage means include a plurality of ports adapted to be brought into registry with said pockets, said ports being formed in said stationary scroll means and arranged on a circle of a predetermined radius from the center of said end member of said stationary scroll means.

22. A scroll-type fluid machine as claimed in claim 5, wherein said pockets are arranged at substantially equal annular intervals on a circle of a predetermined radius from a center of said stationary scroll means and said liquid supplying passage means include ports, adapted to be brought into registry with said pockets, arranged on a circle of a predetermined radius from the center of said end member of said orbiting scroll means.

23. A scroll-type fluid machine as claimed in claim 5, wherein said pockets are arranged on a circle of a predetermined radius from a center of said end member of said orbiting scroll means and said liquid supply passage means include ports which are open to said pockets and are arranged on the same circle as said pockets.

24. A scroll-type fluid machine as claimed in claim 5, wherein a least three pockets are provided and said liquid supplying passage means include at least three ports.

25. A scroll-type fluid machine as claimed in claim 6, wherein said pockets are arranged at substantially equal angular intervals on a circle of a predetermined radius from a center of said end member of said orbiting scroll means and said liquid supplying passage means include a plurality of ports adapted to be brought into registry with said pockets, said ports being formed in said stationary scroll means and arranged on a circle of a predetermined radius from the center of said end member of said stationary scroll means.

26. A scroll-type fluid machine as claimed in claim 6, wherein said pockets are arranged at substantially equal annular intervals on a circle of a predetermined radius from a center of said stationary scroll means and said liquid supplying passage means include ports, adapted to be brought into registry with said pockets, arranged on a circle of a predetermined radius from the center of said end member of said orbiting scroll means.

27. A scroll-type fluid machine as claimed in claim 6, wherein said pockets are arranged on a circle of a predetermined radius from a center of said end member of said orbiting scroll means and said liquid supplying passage means include ports which are open to said pockets and are arranged on the same circle as said pockets.

28. A scroll-type fluid machine as claimed in claim 6, wherein at least three pockets are provided and said liquid supplying passage means includes at least three ports.

29. A scroll-type fluid machine as claimed in claim 7, wherein at least three pockets are provided and said liquid supplying passage means include at least three ports.

30. A scroll-type fluid machine as claimed in claim 8, wherein at least three pockets are provided and said liquid supplying passage means include at least three ports.

31. A scroll-type fluid machine as claimed in claim 9, wherein at least three pockets are provided and said liquid supplying passage means include at least three ports.

32. A scroll-type fluid machine as claimed in claim 15, wherein said pockets are arranged at substantially equal angular intervals on a circle of a predetermined radius from a center of said end member of said orbiting scroll means and said liquid supplying passage means includes a plurality of ports adapted to be brought into registry with said pockets, said ports being formed in said stationary scroll means and arranged on a circle of a predetermined radius from the center of said end member of said stationary scroll means.

33. A scroll-type fluid machine as claimed in claim 15, wherein said pockets are arranged at substantially equal angular intervals on a circle of a predetermined radius from a center of said stationary scroll means and said liquid supplying passage means includes ports adapted to be brought into registry with said pockets and arranged on a circle of a predetermined radius from the center of said end member of said orbiting scroll means.

34. A scroll-type fluid machine as claimed in claim 15, wherein said pockets are arranged on a circle of a predetermined radius from a center of said end member of said orbiting scroll means and said liquid supplying passage means includes ports which are open to said pockets, said ports are arranged on the same circle as said pockets.

35. A scroll-type fluid machine as claimed in claim 15, wherein at least three pockets are provided and wherein said liquid supplying passage means include at least three ports.

36. A scroll-type fluid machine as claimed in claim 16, wherein said pockets are arranged at substantially equal angular intervals on a circle of a predetermined radius from a center of said end member of said orbiting scroll means and said liquid supplying passage means includes a plurality of ports adapted to be brought into registry with said pockets, said ports being formed in said stationary scroll means and arranged on a circle of a predetermined radius from the center of said end member of said stationary scroll means.

37. A scroll-type fluid machine as claimed in claim 16, wherein said pockets are arranged at substantially equal angular intervals on a circle of a predetermined radius from a center of said stationary scroll means and said liquid supplying passage means include ports adapted to be brought into registry with said pockets and arranged on a circle of a predetermined radius from the center of said end member of said orbiting scroll means.

38. A scroll-type fluid machine as claimed in claim 16, wherein said pockets are arranged on a circle of a predetermined radius from a center of said end member of said orbiting scroll means and said liquid supplying passage means include ports which are open to said pockets, said ports are arranged on the same circle as said pockets.

39. A scroll-type fluid machine as claimed in claim 16, wherein at least three pockets are provided and wherein said liquid supplying passage means include at least three ports.

40. A scroll-type fluid machine as claimed in claim 17, wherein at least three pockets are provided and wherein said liquid supplying passage means include at least three ports.

41. A scroll-type fluid machine as claimed in claim 18, wherein at least three pockets are provided and wherein said liquid supplying passage means include at least three ports.

42. A scroll-type fluid machine as claimed in claim 19, wherein at least three pockets are provided and wherein said liquid supplying passage means include at least three ports.

* * * * *